US005335633A

United States Patent [19]

Thien

[11] Patent Number: 5,335,633

[45] Date of Patent: Aug. 9, 1994

[54] INTERNAL COMBUSTION ENGINE VALVE ACTUATOR APPARATUS

[76] Inventor: James L. Thien, 3310 Timberview Ct. SW, Issaquah, Wash. 98027

[21] Appl. No.: 74,356

[22] Filed: Jun. 10, 1993

[51] Int. Cl.[5] ..... F01L 9/02

[52] U.S. Cl. ..... 123/90.12

[58] Field of Search ..... 123/90.12, 90.13

[56] References Cited

U.S. PATENT DOCUMENTS

| | | | |
|---|---|---|---|
| 885,459 | 4/1908 | Engler et al. | 123/90.12 |
| 2,962,013 | 11/1960 | Reggio | 123/90.12 |
| 3,209,737 | 10/1965 | Omotehara et al. | 123/90.12 |
| 4,791,895 | 12/1988 | Tittizer | 123/90.12 |
| 4,930,464 | 6/1990 | Letsche | 123/90.12 |
| 5,022,358 | 6/1991 | Richeson | 123/90.12 |
| 5,248,123 | 9/1993 | Richeson et al. | 123/90.12 |

FOREIGN PATENT DOCUMENTS

| | | | |
|---|---|---|---|
| 206606 | 11/1984 | Japan | 123/90.12 |
| 206607 | 11/1984 | Japan | 123/90.12 |

*Primary Examiner*—Raymond A. Nelli
*Assistant Examiner*—Weinlun Lo
*Attorney, Agent, or Firm*—Gary Alan Culliss

[57] ABSTRACT

An internal combustion engine valve actuator apparatus for operating an intake valve or an exhaust valve of an engine. The valve actuator apparatus operates by selectively allowing fluid from a pressure source to flow into a valve actuator causing either an opening or a closing of the associated valve. The fluid is directed through a spool valve and solenoid arrangement which is controlled by a computer. The valve actuator apparatus also includes a solenoid powered actuator which operates by direct mechanical communication with the associated valve.

2 Claims, 3 Drawing Sheets

FIG 1
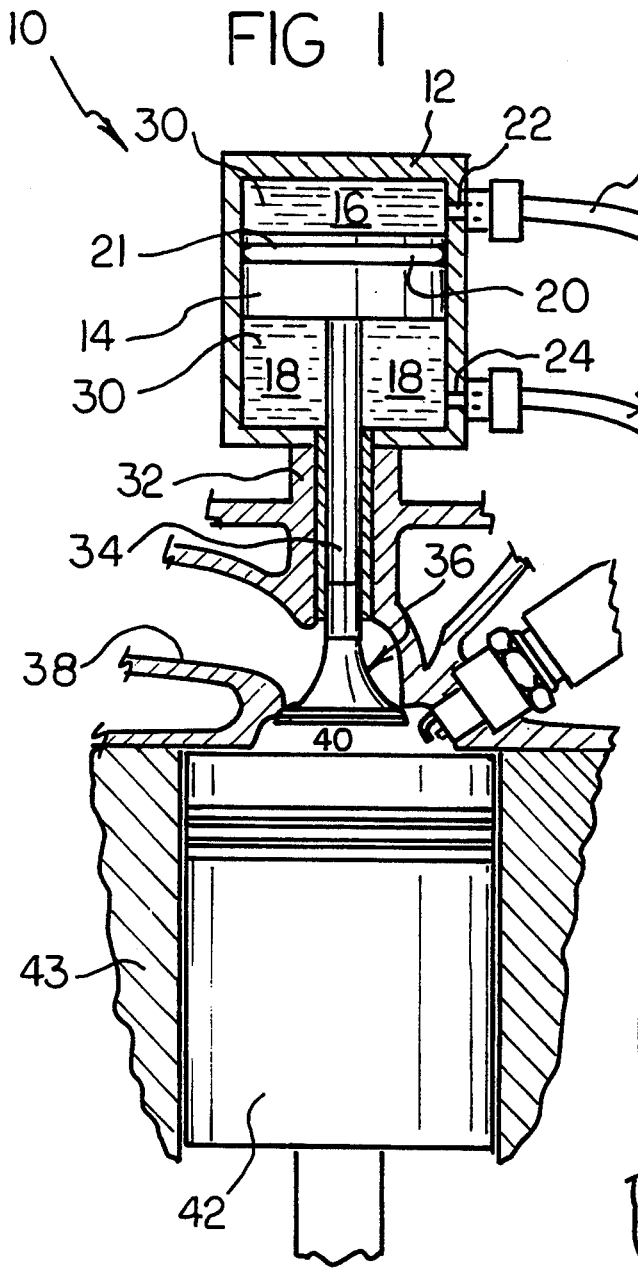
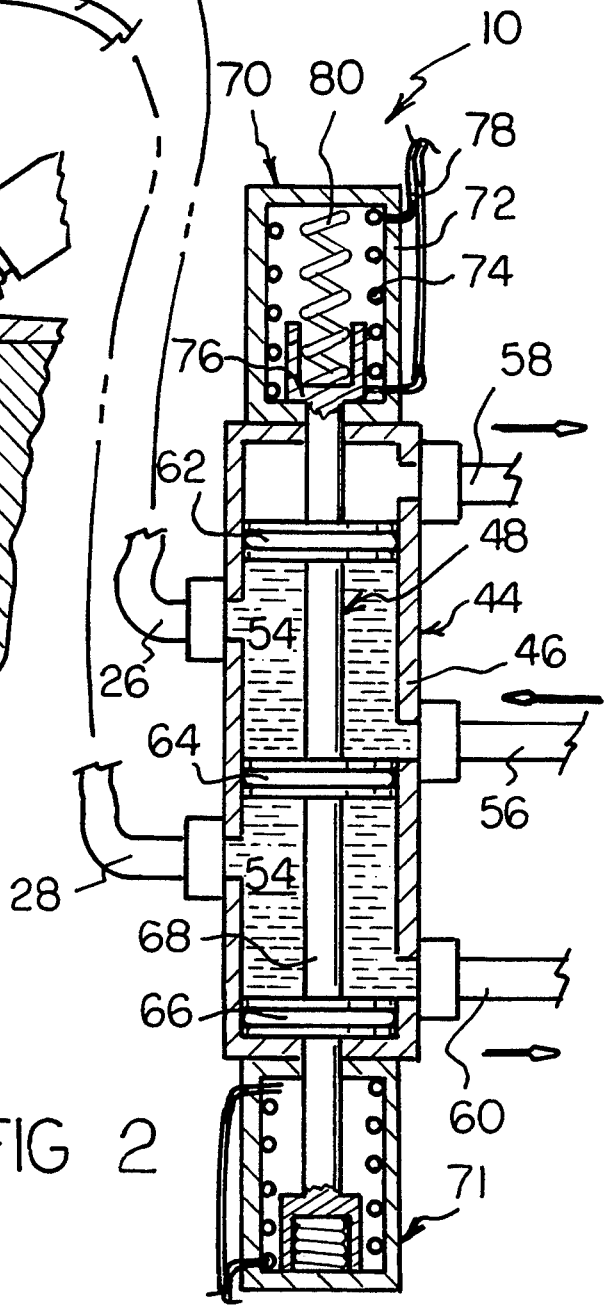
FIG 2

INTERNAL COMBUSTION ENGINE VALVE ACTUATOR APPARATUS

BACKGROUND OF THE INVENTION

1. Field of the Invention

The present invention relates to valves and more particularly pertains to internal combustion engine valves which may be operated by means other than a conventional cam and follower arrangement.

2. Description of the Prior Art

An internal combustion engine utilizes valves for controlling a flow of an engine's intake and exhaust gases. Conventionally, a camshaft is mechanically coupled to a crankshaft of the engine by a timing belt and pulley arrangement. The camshaft has a plurality of lobes which are utilized to engage and operate respectively positioned valves.

However, since intake and exhaust valves are opened and closed by the camshaft as described above, valve timing is determined solely by a profile of the camshaft. Utilizing a conventional camshaft, it is impossible to vary the valve timing depending upon an engine's rotational speed. An engine's valve timing requirement for optimum performance and efficiency varies as a function of engine speed. Therefore, it is desirable that a valve be provided with a means for selectively operating the valve depending upon the engine's speed and other factors.

Valve actuators operable for providing variable valve timing are known in the prior art. More specifically, the devices heretofore devised and utilized for the purpose of actuating internal combustion engine valves are known to consist basically of familiar, expected and obvious structural configurations, notwithstanding the myriad of designs encompassed by the crowded prior art which have been developed for the fulfillment of countless objectives and requirements.

For example, a valve control system for an internal combustion engine is illustrated in U.S. Pat. No. 5,076,222 which utilizes an electromagnetic actuator for operating intake and exhaust valves of an engine.

U.S. Pat. No. 5,009,202 describes an electromagnetically operated valve assembly for use in an internal combustion engine that includes a ceramic valve with an increased magnetic cross section area.

In view of the prior art, it can be appreciated that there exists a continuing need for new and improved internal combustion valve actuator apparatuses which can be utilized to provide variable valve timing on an internal combustion engine. In this regard, the present invention substantially fulfills this need.

SUMMARY OF THE INVENTION

In view of the known types of valves now present in the prior art, the present invention provides a new internal combustion valve actuator apparatus construction wherein the same can be utilized for operating an intake or exhaust valve of an engine. As such, the general purpose of the present invention, which will be described subsequently in greater detail, is to provide a new internal combustion valve actuator apparatus that has many of the advantages of the valve actuators mentioned heretofore and many novel features which result in an internal combustion valve actuator apparatus that is not anticipated, rendered obvious, suggested, or even implied by any of the prior art valve actuators, either alone or in any combination thereof.

To attain this, the present invention essentially comprises an internal combustion valve actuator apparatus for actuating an intake valve or an exhaust valve of an engine. The valve actuator apparatus operates by selectively allowing fluid from a pressure source to flow into a valve actuator to cause either an opening or a closing of the associated valve. The fluid is received from a pressure source and is directed through a spool valve and solenoid arrangement which is controlled by a computer. The valve actuator apparatus also includes a solenoid powered actuator which operates by direct mechanical communication with the associated valve.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new internal combustion valve actuator apparatus which has many of the advantages of the valves mentioned heretofore and many novel features that result in a internal combustion valve actuator apparatus which is not anticipated, rendered obvious, suggested, or even implied by any of the prior art valves, either alone or in any combination thereof.

It is another object of the present invention to provide a new internal combustion valve actuator apparatus which may be easily and efficiently manufactured and marketed.

It is a further object of the present invention to provide a new internal combustion valve actuator apparatus which is of a durable and reliable construction.

An even further object of the present invention is to provide a new internal combustion valve actuator apparatus which is susceptible of a low cost of manufacture with regard to both materials and labor, and which accordingly is then susceptible of low prices of sale to the consuming public, thereby making such internal combustion valve actuator apparatuses economically available to the buying public.

Still yet another object of the present invention is to provide a new internal combustion valve actuator apparatus which provides in the apparatuses and methods of the prior art some of the advantages thereof, while simultaneously overcoming some of the disadvantages normally associated therewith.

Still another object of the present invention is to provide a new internal combustion valve actuator apparatus for operating an intake valve or an exhaust valve of an engine.

Yet another object of the present invention is to provide a new internal combustion valve actuator apparatus which operates by selectively allowing fluid from a pressure source to flow into a valve actuator causing a movement of an associated valve.

Even still another object of the present invention is to provide a new internal combustion valve actuator apparatus that includes a solenoid powered actuator which operates by direct mechanical communication with an associated valve.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevation view, partially in cross section, of a portion of an internal combustion valve actuator apparatus comprising the present invention.

FIG. 2 is a side elevation view, partially in cross section, of a further portion of the present invention.

DESCRIPTION OF THE PREFERRED EMBODIMENT

Figure 3:
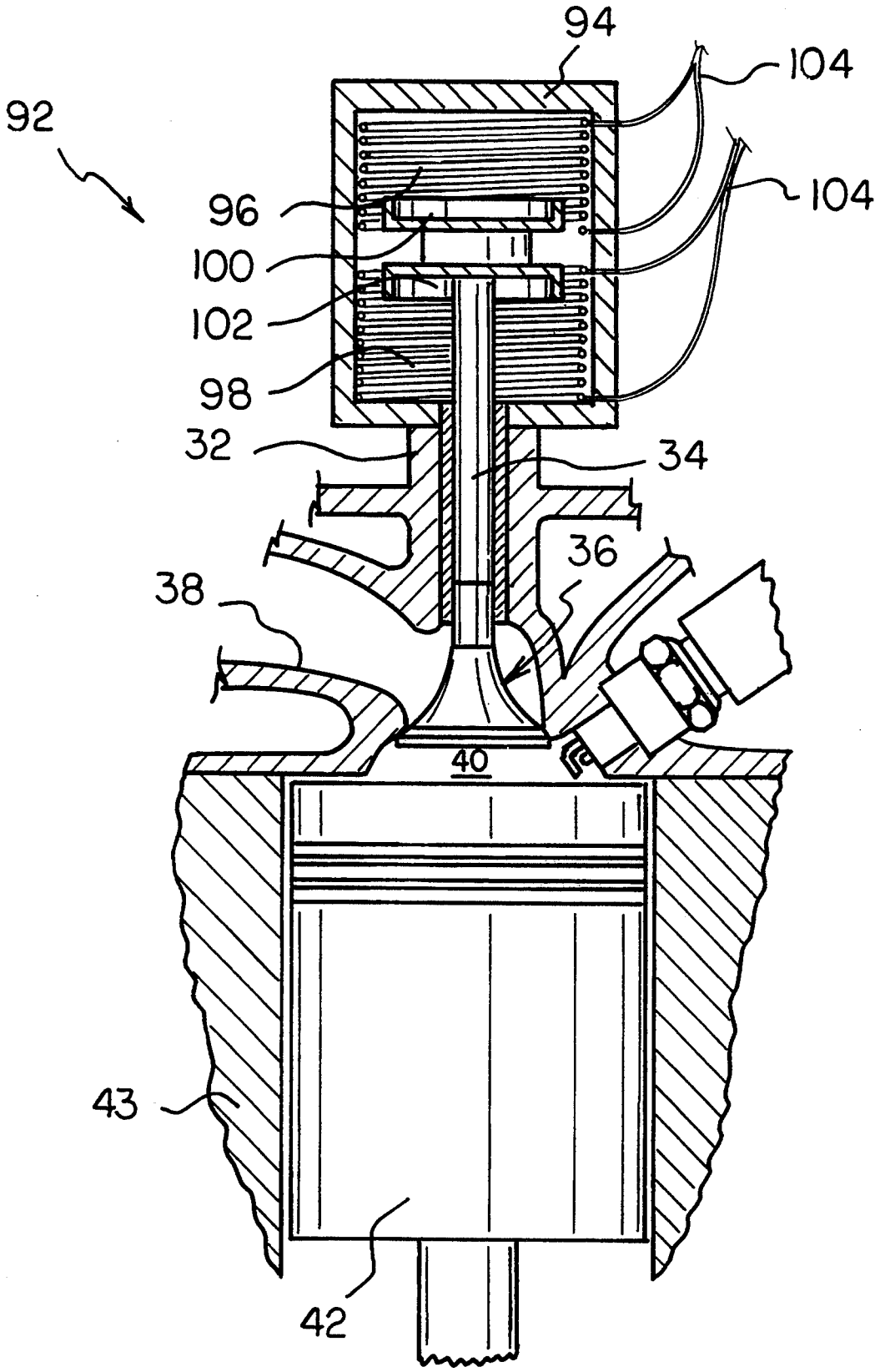
FIG. 3 is a side elevation view, partially in cross section, of a second embodiment of the invention.

With reference now to the drawings, and in particular to FIGS. 1–2 thereof, a new internal combustion valve actuator apparatus embodying the principles and concepts of the present invention and generally designated by the reference numeral 10 will be described.

More specifically, it will be noted that the internal combustion valve actuator apparatus 10 comprises an actuator body 12 which defines a substantially enclosed cylindrical container. The actuator body 12 supports therein a valve piston 14 which forms a movable partition between an upper fluid space 16 and a lower fluid space 18. The valve piston 14 supports a seal 20 within a journal 21 that engages an interior of the actuator body 12 to prevent fluid communication between the upper fluid space 16 and the lower fluid space 18.

Fluid may enter the actuator body 12 through a pair of apertures 22, 24 located in the actuator body. The aperture 22 is positioned so as to allow fluid communication between the upper fluid space 16 and a first hydraulic line 26 which is secured to the actuator body 12 in a well understood manner. The aperture 24 is connected to a second hydraulic line 28 in a substantially similar manner as the first hydraulic line 26. Upon an entrance of hydraulic fluid 30 through either the first hydraulic line 26 or the second hydraulic line 28, the valve piston will move in either a downward direction or an upward direction, respectively, as best illustrated in FIG. 1.

The actuator body 12 is secured to an engine head 32 by any conventional means such as a threaded engagement (not shown) in a manner that allows a valve stem 34 of an engine valve 36 to project into the actuator body where it may be mechanically coupled to the valve piston 14. The valve 36 may then be selectively operated by a controlled distribution of hydraulic fluid 30 to both the upper fluid space 16 and the lower fluid space 18. It is in this manner that the valve 36 may be operated to allow a fuel-air mixture to be drawn in through an intake port 38 into a combustion chamber 40 by a movement of an engine piston 42 in a conventional engine 43.

To facilitate a controlled distribution of hydraulic fluid to both the upper fluid space 16 and the lower fluid space 18, the present invention 10 utilizes a spool valve 44. Referring to FIG. 2 with concurrent reference to FIG. 1, it can be seen that the spool valve 44 comprises a valve body 46 that is substantially cylindrical in shape and which encloses a divider assembly 48. The valve body 46 defines an internal fluid space 54 that may be selectively partitioned by the divider assembly 48 to provide fluid communication between a pressure line 56 and either the first hydraulic line 26 or the second hydraulic line 28.

While allowing fluid communication between the pressure line 56 and either the first 26 or second 28 hydraulic line, the divider assembly 48 further allows fluid communication between either the first or second hydraulic line and either a first drain line 58 or a second drain line 60, respectively. The divider assembly is comprised of a plurality of dividers 62, 64, and 66 which are positioned upon a divider rod 68 so that a selective positioning of the rod will partition the valve body to provide the above described communication. The divider rod 68 projects outside both a top area and a bottom area (not labeled) of the valve body 46 to allow for an external movement of the divider rod relative to the valve body. The spool valve as described above, allows pressurized hydraulic fluid 30 to be selectively directed from the pressure line 56 to the actuator body 12 while simultaneously allowing a return of hydraulic fluid from the actuator body to the first and second drain lines 58, 60, as best shown in FIG. 2.

The spool valve 44 may be operated by a movement of the divider assembly 48 through a motion of the divider rod 68. A pair of solenoids 70, 71 are mounted at respectively opposed ends of the valve body 46. The solenoids 70, 71 are operable to move the divider rod 68 into either of two predetermined positions, thereby to allow an actuation of the spool valve 44 and a subsequent movement of the engine valve 36.

The solenoids 70, 71 solenoids are substantially similar in design and function and therefore only one will be described in detail with it being understood that both solenoids are comprised of substantially similar objects and that other conventional solenoid designs may be utilized for the intended purpose of the present invention 10. The solenoid 70 is comprised of solenoid casing 72 which houses an electrical coil 74 on an interior surface therein. A permanent magnet 76 is attached to an end of the divider rod 68 so as to cause a predetermined movement of the divider rod upon a selective energization of the coil 74 through wires 78. A spring 80 is positioned within the solenoid casing 72 and contacts both the solenoid casing and the permanent magnet 76. The solenoids 70, 71 may be selectively energized by any conventional means at an appropriate time to produce a subsequent operation of the engine valve 36 with the above described structure.

Figure 4:
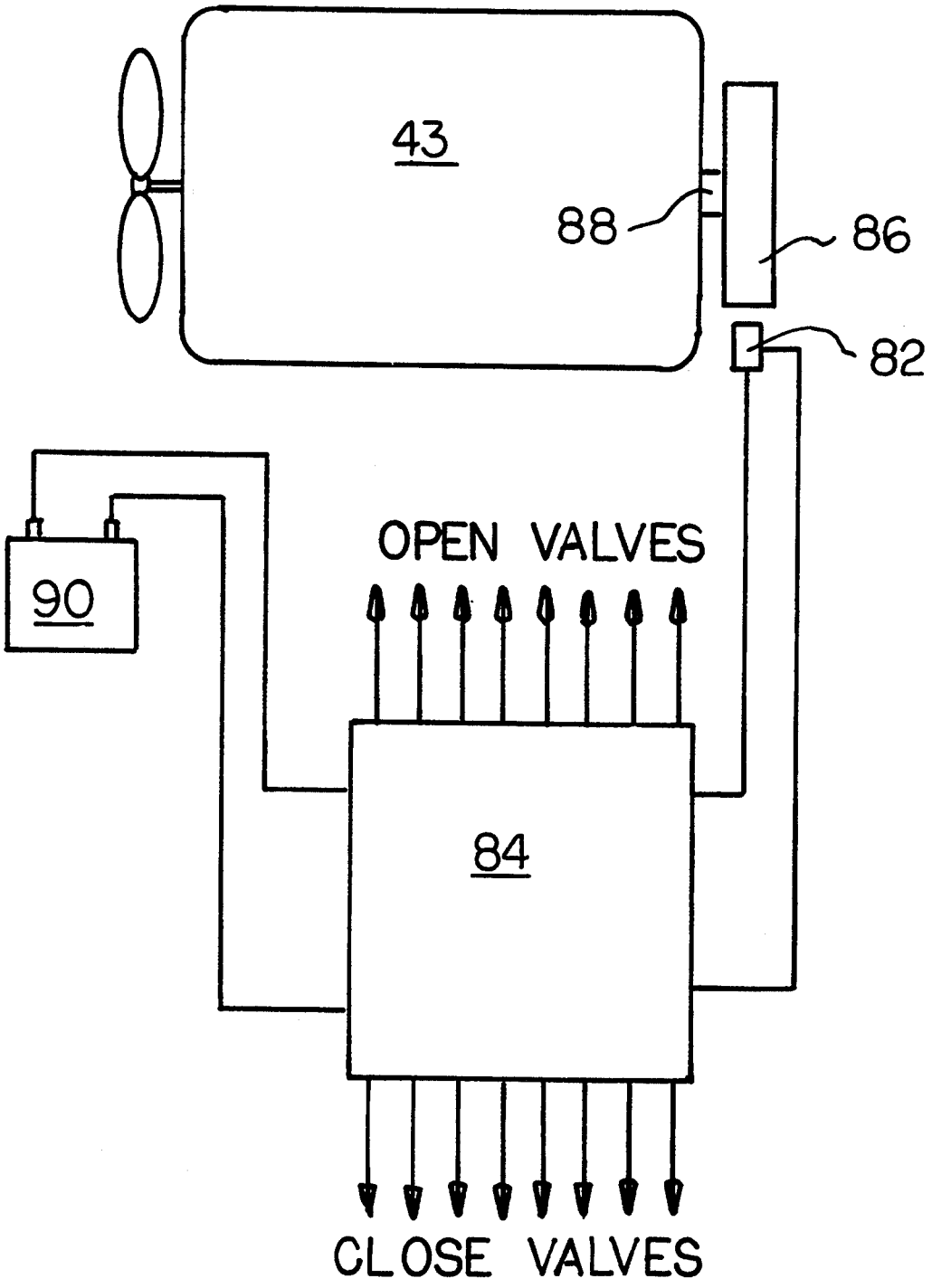
FIG. 4 is a schematic of a portion of the present invention.

To facilitate a variably timed energization of each of the solenoids 70, 71, the present invention 10 utilizes an engine sensor 82 for detecting the rotational position of the engine 43 and a controller 84, as shown in FIG. 4. The engine sensor 82 is positioned in a confronting relationship to an engine component, such as a flywheel 86, that allows a position of the crankshaft 88 to be determined with conventional detection means utilized within the engine sensor 82. A signal is sent from the engine sensor 82 to the controller 84, whereby appropriate solenoids 70, 71 may be selectively energized by the battery 90.

A second embodiment of the present invention which comprises substantially all of the features of the foregoing embodiment 10, and which is generally designated by the reference numeral 92, can be seen in FIG. 3. The second embodiment 92 comprises an actuator body 94 which is substantially cylindrical in shape and which has both a first and a second solenoid coil 96, 98 located on an upper and a lower interior surface, respectively, of the actuator body. The actuator body 94 is secured to the engine head 32 by any conventional means such as a threaded engagement (not shown) in a manner that allows the valve stem 34 of the engine valve 36 to project into the actuator body.

A pair of permanent magnets 100, 102 are disposed within the actuator body 94 and are arranged in abutting relationship to each other on a top area of the valve stem 34. The magnets 100, 102 are operable to bias the engine valve 36 into either a closed or an open position upon an energization of either the first 96 or the second 98 solenoid coil, respectively. The solenoid coils 96, 98 may be energized through a plurality of wires 104 in a well understood manner. With a selective energization of the solenoid coils 96, 98, the valve 36 may be opened and subsequently closed after allowing a fuel-air mixture to be drawn in through the intake port 38 and into the combustion chamber 40 by a movement of the engine piston 42 of the engine 43.

The solenoid coils 96, 98 may be operated by the controller 84 as was done in the previous embodiment 10 with it being understood that other methods of operating either of the two embodiments 10, 92 may be utilized in accordance with any conceivable engine condition which may be selected by one who is skilled in the art.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An internal combustion engine valve actuator apparatus comprising:

a substantially cylindrical actuator body having an interior sidewall with first and second actuator body apertures extending through said sidewall, said actuator body being mountable to an engine head and permitting entrance of a valve stem of a valve therewithin;

a valve piston slidably positioned within said actuator body and coupled to said valve stem, said valve piston movably dividing said actuator body into an upper fluid space in communication with said first actuator body aperture and a lower fluid space in communication with said second actuator body aperture, said valve piston including a journal within which a seal is positioned to contact said interior sidewall of said actuator body to prevent fluid communication between said upper fluid space and said lower fluid space;

a first hydraulic line coupled to said actuator body in communication with said first actuator body aperture;

a second hydraulic line coupled to said actuator body in communication with said second actuator body aperture;

a spool valve including a valve body substantially cylindrical in shape having first and second ends and further having an internal fluid space with first and second drain apertures extending through said valve body in communication with said internal fluid space for permitting exit of a drain fluid, said valve body further having a first rod aperture extending longitudinally through said first end of said valve body, a second rod aperture extending longitudinally through said second end of said valve body, a first valve body aperture in fluid communication with said first actuator body aperture, a second valve body aperture in fluid communication with said second actuator body aperture, and a pressure aperture extending through said valve body, said pressure aperture facilitating an introduction of high pressure fluid from a pressure source to within said valve body;

a divider rod having first and second divider rod ends, said divider rod extending longitudinally through said valve body through both said first and second rod apertures;

a first divider sealingly positioned within said valve body, said first divider being mounted to said divider rod;

a third divider sealingly positioned within said valve body, said third divider being mounted to said divider rod spaced from said first divider;

a second divider sealingly positioned within said valve body, said second divider being mounted to said divider rod medially between said first and third dividers, said dividers being cooperatively operable to move from a first position allowing simultaneous passage of said high pressure fluid from said pressure aperture through said first valve body aperture and passage of said drain fluid from said second valve body aperture through said second drain aperture to a second position allowing simultaneous passage of said high pressure fluid from said pressure aperture through said second valve body aperture and passage of said drain fluid from said first valve body aperture through said first drain aperture;

a first solenoid mounted to said first end of said valve body, said first solenoid including a first permanent magnet attached to said first end of said divider rod; and, a second solenoid mounted to said second end of said valve body, said second solenoid including a second permanent magnet attached to said second end of said divider rod, said solenoids being cooperatively operable to move said divider rod within said valve body between said first position allowing simultaneous passage of said high pressure fluid from said pressure aperture through said first valve body aperture and passage of said drain fluid from said second valve body aperture through said second drain aperture to move said valve stem in a first direction to open said valve, to said second position allowing simultaneous passage of said high pressure fluid from said pressure aperture through said second valve body aperture and passage of said drain fluid from said first valve body aperture through said first drain aperture to move said valve stem in a second direction to close said valve.

2. The internal combustion engine valve actuator apparatus of claim 1, wherein each of said solenoids comprises a solenoid casing, and further comprising first and second coil springs, with said first spring being interposed between said solenoid casing of said first solenoid and said first permanent magnet, and said second spring being interposed between said solenoid casing of said second solenoid and said second permanent magnet.

* * * * *